US005224622A

United States Patent [19]

Graham et al.

[11] Patent Number: 5,224,622

[45] Date of Patent: Jul. 6, 1993

[54] RECOVERY PAN

[75] Inventors: Garry M. Graham, Calgary; Ola S. Moseson, Red Deer, both of Canada

[73] Assignee: Novacor Chemicals Ltd., Calgary, Canada

[21] Appl. No.: 971,295

[22] Filed: Nov. 4, 1992

[30] Foreign Application Priority Data

May 12, 1992 [CA] Canada ..... 2068444

[51] Int. Cl.[5] ..... B65D 90/24

[52] U.S. Cl. ..... 220/571; 220/694

[58] Field of Search ..... 220/571, 573, 1.5, 2, 220/4.01, 476, 477, 480, 853, 694

[56] References Cited

U.S. PATENT DOCUMENTS

| | | | |
|---|---|---|---|
| 4,651,887 | 3/1987 | Patrick | 220/571 |
| 4,712,382 | 12/1987 | LeClean | 220/571 |
| 4,877,261 | 10/1989 | Heisson | 220/571 |
| 5,118,004 | 6/1992 | Carilli | 220/571 |

*Primary Examiner*—Joseph Man-Fu Moy

*Attorney, Agent, or Firm*—Bruce E. Harang

[57] ABSTRACT

A recovery pan for use in unloading rail hopper cars comprises a bracket and retaining means to fix the pan to the track. This keeps the pan in place to catch any spillage during loading, unloading or cleaning of the hopper car.

25 Claims, 1 Drawing Sheet

RECOVERY PAN

FIELD OF THE INVENTION

The present invention relates to a spill pan for use with unloading or cleaning of rail hopper cars which carry particulate material and particularly polymer resins.

BACKGROUND OF THE INVENTION

Commodity plastic resins may be transported using a number of different techniques. Generally bulk transportation is the most economic. For many locations the resins are air conveyed from and into rail hopper cars. Typically the hopper cars have a valve at the bottom. During loading, unloading and washing of tank cars for particulate materials such as polymer resins often there is some spillage about the bottom valve of the rail car. There is a high concern regarding monomer migration into or through the soil. The resin pellets on the ground need to be collected and disposed of. Typically this is a labour intensive operation requiring some type of sweeping and gathering operation.

Currently there is no simple efficient device which would ameliorate the problem of spillage.

The difficulty with various open top containers is that they tend to move during the loading, unloading or washing and as a result there is still spillage. If the containers are made larger or are fixed in place it is difficult to stop the rail car exactly over the open top container. On the other hand a portion of the entire track bed could be covered with a smooth surface, such as a plastic sheet or concrete. This may not make the collection problem any easier as there is a larger surface over which the resin pellets may be spilled. If the surface is permanent then there may be difficulties with the rail bed.

Accordingly, there is a need for a portable, fixable device which may be used in association with the loading, unloading and washing of rail hopper cars used for the transportation of particulate material.

SUMMARY OF THE INVENTION

The present invention seeks to over come the above noted drawbacks by providing a rail hopper car recovery pan comprising an open top pan having at least one longitudinal dimension extending between the tracks upon which the rail car is riding which is from 0.45 to 0.95 the gauge of the tracks, side walls having a height greater than the height of the track but less than the height from the track bed of the bottom outlet of the rail hopper car, a bottom co-operating with said side walls, and a retaining means which co-operates or is integral with said open top pan to form an inverted "U" shaped bracket having a width to closely fit over a rail of the tracks and a depth to permit at least a third of the bracket to overlap at least the top quarter of said rail.

DETAILED DESCRIPTION

Figure 1:
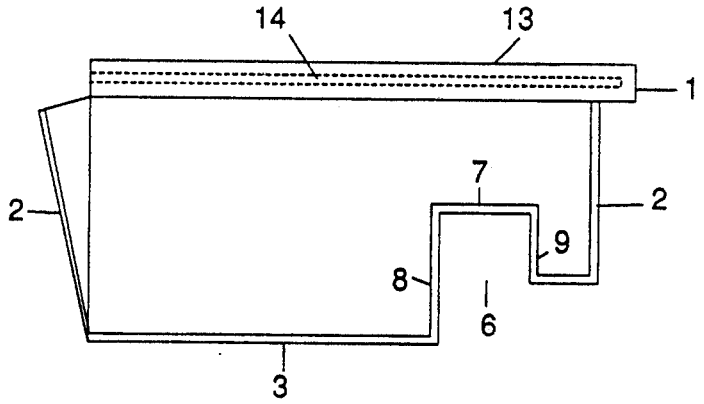
FIG. 1 is a side view of one embodiment of a spill pan in accordance with the present invention.
Figure 2:
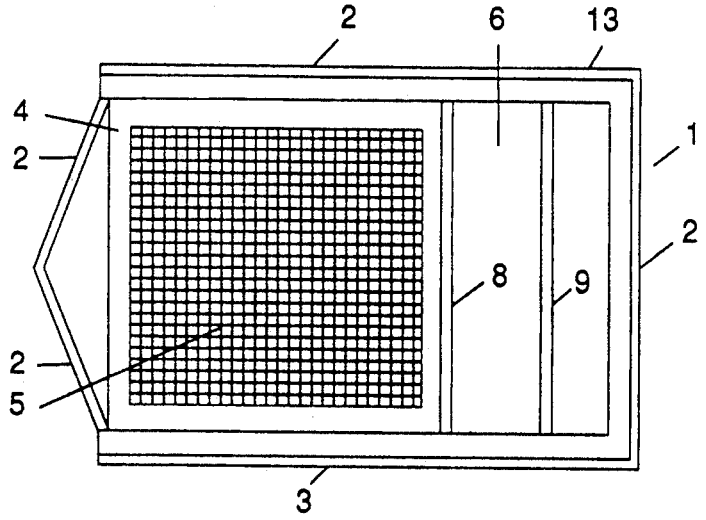
FIG. 2 is a top view of the embodiment of FIG. 1.
Figure 3:
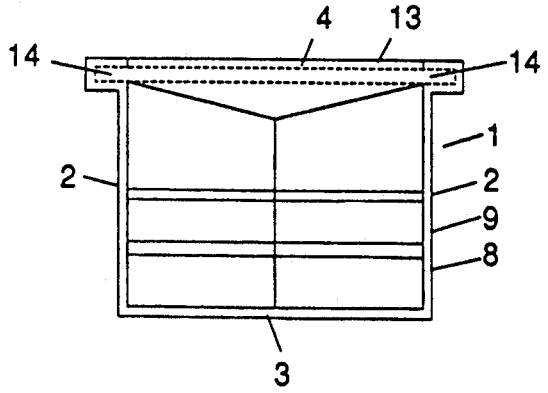
FIG. 3 is a front view of the embodiment of FIG. 1.

The spill pan of the present invention comprises an open top pan having at least one longitudinal dimension from 0.45 to 0.95, preferably from 0.7 to 0.85 of the gage (e.g. the distance between the rails) of the tracks on which the tank car is moved. The longitudinal dimension of the tray should be such that the valve of the tank car will overlap the interior portion of the pan. The track gage in North America is 56.5 inches (4 feet 8.5 inches). In one embodiment of the invention the length of the side walls of a pentagonal pan is 24.5 inches and the spout formed by the two front walls of the pan is another 3 inches. This gives a total longitudinal dimension of 27.5 inches and a ratio of pan length to track gage of about 0.5:1.

The pan may be any shape but is preferably a polygon having from 4 to 9 sides. Although a larger number of sides could be used in making the pan it would be expensive to fabricate such multisided pans. It should be born in mind that the greater number of sides on the pan generally the shorter the length of the inverted "U" shaped bracket.

The side walls of the pan should be high enough to retain any resin pellets which fall from the tank car during transfer of product or cleaning. Typically the walls of the pan will be higher than the height of the rails upon which the tank car moves. However, the walls should not be so high as to make it difficult to place the pan beneath the bottom outlet or vent of the rail car. The height of the walls should be less than the clearance from the track bed of the bottom outlet or vent of the tank car. Typically the walls of the pan will be from about 1.1 to 2, most preferably from about 1.3 to 1.5 times the height of the rails of the train track.

The bottom of the pan co-operates with or is integral with the side walls. The bottom of the pan may be a solid or at least a portion of the bottom, or side wall, preferably not less than 50, preferably more than 75 most preferably more than 85% of the surface area of the bottom may be an open grid or mesh. The mesh size should be sufficiently small to retain resin pellets. The area of the mesh should be sufficient to permit wash fluid such as water to drain through the bottom of the pan at a rate sufficient to permit normal rates of washing without the pan overflowing. Typically the mesh size may be from about 1/16 to about ⅛ of an inch.

In a further embodiment a cover extending over at least a portion of the top of the pan may engage the side walls of the pan. The top may have a mesh or screen in it. Wash water may then pass through the cover and overflow the pan through the uncovered portion of the tray or pan (e.g. the spout of for example a pentagonal pan).

These various embodiments in which parts of the pan comprise a mesh or screen are important for separating resin pellets from wash water. If the resin has a density less than that of water, such as low density polyethylene if wash water overflows the pan or tray it will carry away resin particles. If the tray is designed to either have a partially meshed or screened bottom or side walls or uses a cover or lid with a screen or mesh in it and an (overflow) spout then resins may be easily separated from wash water. This provides a further saving as the wash water may then be recycled.

In accordance with the present invention there is a retaining means which co-operates with or is integral with the pan to form an inverted "U" shaped bracket. The inverted "U" shaped bracket should have a width to closely fit over the width of the rails of the track and a depth to permit the bracket to overlap with at least the top third of the track. If the bracket is integral with the pan it may have a depth at least equal to the height of the track. In the embodiment shown in the drawings the back wall of the inverted "U" shaped bracket or channel need not extend all the way to the ground. Preferably the inverted "U" shaped bracket will form an inverted "U" shaped channel. If the inverted "U" shaped bracket or channel is integral with the pan it should be in the back quarter or less of the pan. Of course care should be taken to ensure the dimension of the pan extending beneath the tank car is sufficient to extend beyond the valve or outlet of the tank car.

The retaining means may be a "L" shaped member which securely engages at least one wall of the pan. The engaging means could be a number of devices such as simple bracket which fits into channels on a wall of the pan, or pin or bolt type fastening means or it could be fairly sophisticated such as a dovetail joint. There are many means available to securely join or engage the pan and the retaining means.

The walls defining the inverted "U" shaped bracket may be vertical so the bracket or channel will fit closely over the track. However, as shown in the figure one of he walls defining the bracket or channel could be off vertical. The wall may be and led up to 15, preferably about 10° off vertical. This helps to easily place the tray over the track. Preferably, the remaining walls of the pan or tray will be off vertical, in a similar amount or degree, to help keep the tray or pan in place when it is subjected to wash water.

In a further optional embodiment the inverted "U" shaped bracket or channel may further bear one or more adjustable clamping means to engage the track. The clamping means preferably will engage the track on the narrow body portion of the "I" shaped track rather than on the bulbous head or bottom of the track. There are a number of suitable clamping means. The simplest is one or more bolts which are threaded through one or more of the walls defining the inverted "U" shaped bracket or channel. Preferably the bolt will have an enlarged head so that it may be easily screwed into engagement with the track. The bolt and the wall of the inverted "U" shaped bracket or channel should be made of material having similar toughness and strength. Using a metal bolt through a plastic wall will only lead to stripping the threads in the wall. The bolt may have a face plate attached to the end which engages the track. This will provide for better engagement and less likelihood of slippage. Alternately a biasing means could be used to engage the track. For example a spring loaded strip with a lever to depress it could be on the inside of the inverted "U" shaped bracket or channel.

The pan may be made from any suitable material. Suitability may depend on a number of factors. Typically resins are not too corrosive and metal could be suitable. However, from a cost point of view it would be cheaper to stamp the parts than cast them. Stamping would be useful where the pan has a simple shape. If the inverted "U" shaped bracket or channel is integral with and internal the pan it may be difficult to stamp the pan. The pan could then be made of the resin it is collecting or a resin compatible with the resin being collected. Typically the tray could be injection molded from an olefinic resin such as polyethylene, polypropylene or an ethylene-propylene copolymer. However, other "engineering resins" such as polyamides (e.g. the "nylons"), polyesters such as polyethylene terephthalate (PET) or polybutlyene terephthalate (PBT), or polycarbonate could also be used.

The present invention will now be described in association with the drawings which are intended to illustrate the invention and not limit it. In the drawings like parts will be designed by like numbers.

In the drawings the broken lines indicate the internal walls of the pan.

The spill pan 1 is pentagonal in shape, having five side walls 2 and a bottom 3. In this particular embodiment a significant portion of the a lid 4 is an open grid or screen 5. Integral with the pan is a generally inverted "U" channel generally indicated as 6. The channel 6 has a top wall 7, and side walls 8 and 9. In the embodiment shown the front wall 8 is about 10° off vertical. The back wall 9 does not extend all the way down to the ground but only engages about the top third of the train track. The height of the inverted "U" shaped channel 6 is slightly higher, from $\frac{1}{8}$ to $\frac{1}{2}$, preferably from $\frac{1}{4}$ to $\frac{1}{2}$ of an inch, than the rail of the tracks and the width is a little wider, from $\frac{1}{8}$ to $\frac{1}{2}$, preferably from $\frac{1}{4}$ to $\frac{1}{2}$ of an inch, than the widest point of a track. Accordingly, the tray may be placed over a rail track. The channel 6 is located towards the back quarter of the pan. The longitudinal dimension of the pan extending into the rail bed is such so that a sufficient area of the pan is below the outlet valve of the train car to catch any spill.

In an optional embodiment at least one of the side walls of the inverted "U" shaped channel may contain one or more clamping means. The clamping means may be a bolt comprising a head and a threaded shaft. The threaded shaft passes through and co-operates with threaded holes in the side wall of the generally inverted "U" shaped channel.

In the embodiment shown in the drawings there is a lip 13 around at least a portion of the top of the pan. The lip contains a channel 14, which is adapted to receive and co-operate with top or lid 4.

In use the tray is placed over a rail in the track bed on which the tank car is riding. The tray is positioned to catch any spillage from the bottom outlet of the tank car. The tank car is then loaded, unloaded or cleaned as the case may be. If the tank car is cleaned the wash water will flow through the screen or grid 5 in the top or lid of the pan but the resin particles will be retained on the top. In the embodiment shown in the drawings, the front walls of the pan are shorter than the side walls an from an open spout. However, the front walls could be of the same, or essentially the same height as the side walls. The wash water will overflow through the spout while the resin is retained on the lid or top. After the operation the tray is removed from beneath the tank car. The tray contains any spillage from the loading or unloading operation or the resin pellets collected from washing may be emptied into the tray or pan and the resin pellets are easily handled.

In a further embodiment a sheet or lid may be inserted into channel 14 to completely seal the pan or tray so the collected resin pellets won't spill.

The foregoing is a description of one embodiment of the present invention. Other embodiments will be apparent to one skilled in the art in view of the disclosure.

What is claimed is:

1. A rail hopper car recovery pan comprising an open top pan having at least one longitudinal dimension extending between the tracks upon which the tank car is riding which is from 0.45 to 0.95 the gauge of the tracks, side walls having a height greater than the height of the track but less than the clearance from the track bed of the bottom outlet of the rail hopper car, a bottom co-operating with said side walls, and a retaining means which co-operates or is integral with said open top pan to form an inverted "U" shaped bracket having a width to closely fit over a rail of the tracks and a depth to permit at least a third of the bracket to overlap at least the top quarter of said rail.

2. The rail hopper car recovery pan according to claim 1, wherein the longitudinal dimension of the open top pan extending between the tracks upon which the rail hopper car is riding is from 0.70 to 0.85 of the gage of the tracks.

3. The rail hopper car recovery pan according to claim 2, wherein the height of the side walls of said open top pan is from 1.3 to 1.5 times the height of the a rail.

4. The rail hopper car recovery pan according to claim 3, wherein at least a 50% of the bottom or of a side wall of said pan is an open grid or mesh having a mesh size from 1/16 to ⅛ of an inch.

5. The rail hopper car recovery pan according to claim 3, further comprising a removable lid having at least 50% of the lid being an open grid or mesh having a mesh size from 1/16 to ⅛ of an inch, said lid co-operating with and engaging at least a portion of the top rim of said pan to define a closed area and a spout.

6. The rail hopper car recovery pan according to claim 4, further comprising an adjustable clamping means which co-operates with said inverted "U" shaped bracket to engage a track.

7. The rail hopper car recovery pan according to claim 5, further comprising an adjustable clamping means which co-operates with said inverted "U" shaped bracket to engage a track.

8. The rail hopper car recovery pan according to claim 6, wherein said adjustable clamping means comprise one or more bolts which are threaded through one or more side walls of said bracket.

9. The rail hopper car recovery pan according to claim 7, wherein said adjustable clamping means comprise one or more bolts which are threaded through one or more side walls of said bracket.

10. The rail hopper car recovery pan according to claim 8, wherein said retaining means defines an inverted "U" shaped channel.

11. The rail hopper car recovery pan according to claim 9, wherein said retaining means defines an inverted "U" shaped channel.

12. The rail hopper car recovery pan according to claim 10, wherein said retaining means is integral with said pan and forms an inverted "U" shaped channel at the back quarter or less of said pan.

13. The rail hopper car recovery pan according to claim 11, wherein said retaining means is integral with said pan and forms an inverted "U" shaped channel at the back quarter or less of said pan.

14. The rail hopper car recovery pan according to claim 12, wherein said retaining means is integral with said pan and forms an inverted "U" shaped channel at the back quarter or less of said pan.

15. The rail hopper car recovery pan according to claim 13, wherein said retaining means is integral with said pan and forms an inverted "U" shaped channel at the back quarter or less of said pan.

16. The rail hopper car recovery pan according to claim 14, wherein said retaining means defines at least a top and one side wall of said inverted "U" shaped bracket and said retaining means co-operates with at least a portion of the side wall of said pan.

17. The rail hopper car recovery pan according to claim 15, wherein said retaining means defines at least a top and one side wall of said inverted "U" shaped bracket and said retaining means co-operates with at least a portion of the side wall of said pan.

18. The rail hopper car recovery pan according to claim 14, in which said pan is a polygon having from 4 to 9 sides.

19. The rail hopper car recovery pan according to claim 15, in which said pan is a polygon having from 4 to 9 sides.

20. The rail hopper car recovery pan according to claim 16, in which said pan is a polygon having from 4 to 9 sides.

21. The rail hopper car recovery pan according to claim 17, in which said pan is a polygon having from 4 to 9 sides.

22. The rail hopper car recovery pan according to claim 18, which is made from an olefinic plastic.

23. The rail hopper car recovery pan according to claim 19, which is made from an olefinic plastic.

24. The rail hopper car recovery pan according to claim 20, which is made from an olefinic plastic.

25. The rail hopper car recovery pan according to claim 21, which is made from an olefinic plastic.

* * * * *